US005852970A

United States Patent [19]

Bornhorst et al.

[11] Patent Number: 5,852,970

[45] Date of Patent: Dec. 29, 1998

[54] UNDERDRIVE OPPOSING ACTION PRESS

[75] Inventors: John B. Bornhorst, New Bremen; Bradley A. Burns, Wapakoneta; Edward A. Daniel, Ft. Loramie; Dale A. Homan, Maria Stein; Rick Oen, Wapakoneta; Brian R. Silverstein, Shaker Heights; Brian A. Watercutter, Minster, all of Ohio

[73] Assignee: The Minster Machine Company, Minster, Ohio

[21] Appl. No.: 755,809

[22] Filed: Nov. 26, 1996

Related U.S. Application Data

[60] Provisional application No. 60/007,552 Nov. 27, 1995.

[51] Int. Cl.[6] ..... B30B 1/28; B30B 15/28

[52] U.S. Cl. ..... 100/53; 72/408; 100/264; 100/282

[58] Field of Search ..... 100/53, 264, 282; 72/407, 408, 450; 83/615, 628

[56] References Cited

U.S. PATENT DOCUMENTS

| | | | |
|---|---|---|---|
| 1,077,840 | 11/1913 | Kinzer . | |
| 1,241,257 | 9/1917 | Wurts et al. | 83/615 |
| 1,967,464 | 7/1934 | Byerlein . | |
| 2,071,001 | 2/1937 | Rode et al. . | |
| 2,232,889 | 2/1941 | Spencer . | |
| 2,532,320 | 12/1950 | Maussnest | 100/264 |
| 2,610,524 | 9/1952 | Maust . | |
| 2,740,450 | 4/1956 | Grotnes . | |
| 3,052,200 | 9/1962 | Dehn et al. . | |
| 3,241,351 | 3/1966 | Hautau et al. . | |
| 3,308,912 | 3/1967 | Voorhees et al. . | |
| 3,427,851 | 2/1969 | Michelson . | |
| 3,695,090 | 10/1972 | Kita . | |
| 3,772,986 | 11/1973 | Kawagoshi et al. . | |
| 3,779,155 | 12/1973 | Ohno . | |
| 3,816,052 | 6/1974 | Schoppee et al. | 100/264 |
| 3,902,347 | 9/1975 | Ridgway et al. . | |
| 4,137,840 | 2/1979 | Kubota . | |
| 4,156,387 | 5/1979 | Portmann . | |
| 4,160,409 | 7/1979 | Portmann . | |
| 4,238,950 | 12/1980 | Carrieri et al. | 100/264 |
| 4,318,295 | 3/1982 | Sindelar . | |
| 4,607,732 | 8/1986 | Ikeoka et al. . | |
| 4,674,357 | 6/1987 | Sugawara et al. . | |
| 4,761,988 | 8/1988 | Kato . | |
| 4,817,456 | 4/1989 | Imanishi et al. . | |
| 4,884,433 | 12/1989 | Kato . | |
| 4,890,476 | 1/1990 | Takahashi et al. . | |
| 4,890,524 | 1/1990 | Brown et al. . | |
| 4,934,173 | 6/1990 | Bakersmans et al. . | |
| 5,136,875 | 8/1992 | Schockman . | |
| 5,168,739 | 12/1992 | Heitze . | |
| 5,182,935 | 2/1993 | Schockman . | |
| 5,218,901 | 6/1993 | Imanishi . | |
| 5,467,705 | 11/1995 | Daniel et al. . | |
| 5,467,706 | 11/1995 | Kato . | |

FOREIGN PATENT DOCUMENTS

| | | | |
|---|---|---|---|
| 0 395 964 | 11/1990 | European Pat. Off. . | |
| 1025966 | 4/1953 | France | 100/264 |
| 867514 | 2/1953 | Germany | 100/264 |
| 31 20 887 | 3/1982 | Germany . | |
| 296 07 230 | 8/1996 | Germany . | |
| 46-15272 | 4/1971 | Japan . | |
| 52-76782 | 6/1977 | Japan . | |
| 61-38797 | 2/1986 | Japan . | |
| 509226 | 7/1939 | United Kingdom | 72/408 |
| 1285181 | 8/1972 | United Kingdom . | |
| 2118693 | 11/1983 | United Kingdom . | |

*Primary Examiner*—Stephen F. Gerrity
*Attorney, Agent, or Firm*—Randall J. Knuth

[57] ABSTRACT

The invention includes a press having two slides disposed in opposed relationship to each other with a single crankshaft connected to each slide whereby rotation of the crankshaft causes each slide to move toward and away from the other slide. A drive mechanism is utilized to rotate the crankshaft. The drive mechanism is located under the two slides to provide protection against oil leaks. Dynamic balancers are utilized to substantially balance press inertia forces during operation, to where over 90 percent of vertical press inertia forces are balanced. By balancing such press inertial, the press may be stopped within one crankshaft revolution.

13 Claims, 12 Drawing Sheets

UNDERDRIVE OPPOSING ACTION PRESS

This patent claims priority from Provisional Patent Application 60/007,552, filed on Nov. 27, 1995, and since expired.

BACKGROUND OF THE INVENTION

1. Field of the invention

The present invention relates to a mechanical press, and, more particularly, to a double action press.

2. Description of the related art

Mechanical presses, for example, stamping presses and drawing presses, include a frame having a crown and bed and a slide supported within the frame for motion toward and away from the bed. Such mechanical presses are widely used for stamping and drawing operations and vary substantially in size and available tonnage depending upon the intended use.

In the container art, the press workpiece or cup is usually formed of steel strip coated a with particular plastic layer. Various types of plastic are utilized to coat the steel. By carefully drawing or stamping the steel strip, containers with an interior plastic coating are created. These plastic liners are attached to the steel so that product contained within the formed can, e.g., liquid, does not touch the steel or metal.

In double action presses, a second slide replaces the bed and reciprocates in opposed relationship to the first slide. Prior double action presses had slides that where driven by a plurality of crankshafts having various connecting arrangements connected to the two slides.

Disadvantages to prior double action presses are that multiple crankshafts are used to drive the opposing slides. These multiple crankshafts cause problems in the press drive, such as increased rotational inertia, which has detrimental effects on the clutches and brakes. Increased inertia causes heat build-up in the clutches and brakes of the press during operation. Slower production speeds are necessary as a result of the increased inertia of the press.

Capital and operating costs are another problem with prior double action presses. There is an increase in the cost of these machines due to the additional machining required for the multiple crankshafts. Costs include the crankshafts themselves, the bearings, and costs associated with increases in the complexity of machining portions of the press.

Prior double action presses are very complex, both in assembly and service requirements. The required gearing, to correctly time the plurality of crankshafts together also increase press complexity. By having a plurality of crankshafts there is a potential for misalignment problems between the crankshafts.

The output of prior double action press machines are reduced by the lack of dynamic balance of the inertial forces created by the slides, which cause vibration to be experienced by the foundation underneath the machine. An increased potential for this vibration to migrate out to neighboring presses near this machine and neighboring building is also evident.

Previous double action presses consume a large area of factory floor space. There are also many additional systems used for each of these presses, particularly when utilized to form beverage or liquid containers from cups of a metal workpiece. Known presses use what are called "Body Makers" and typically there are seven or eight of these machines used with the press. With these "Body Makers", a large volume of chemical solutions are necessary to produce the drawn cup or finished workpiece.

SUMMARY OF THE INVENTION

The present invention provides a press with a single crankshaft to drive an upper and lower slide while dynamically balancing the same. Dynamic balance of the moving slides, in one particular embodiment, utilizes two balancers. One balancer is utilized for the upper slide and one balancer for the lower slide. The press includes an underdrive system which creates special advantages for the press system when utilized in processing workpieces for containers and other goods requiring a very clean work environment. The underdrive system also includes a sealed oil chamber which further increases the cleanliness of the work area of the press.

An advantage of the present invention is that the press is dynamically balanced to the degree that 90 percent or more of the inertial forces are balanced. The press is therefore permitted to run considerably faster than an unbalanced press. Once a press obtains or operates with an unbalanced force of approximately 50 to 55 percent of press weight, an unbalanced press can begin vibrating to the point of potentially breaking off any hold down bolts. At a balance percentage of approximately 80 to 90 percent, as possible with the present invention, press speed is unlimited and is not dependant upon how much inertia the press potentially creates that could lift the machine off of the factory floor. Dynamic balancing to such a percentage of inertial is a particular advantage as far as permissible press speed. A press speed of greater than 400 strokes per minute is therefor possible with the present invention.

Another advantage of the press system of the present invention is that the dynamic balancing also eliminates the vibration severity relative to an unbalanced press machine. Vibration severity corresponds to the peak to peak change in velocities on the slide stroke or on the whole press structure during operation. When a press obtains a peak to peak change in velocity, such as an acceleration rate of 0.52 inches per second squared, the press may have problems with components, such as fittings, electrical components, etc., self destructing and flying off of the machine. The dynamic balanced condition of the present invention assists in preventing such problems.

An advantage of the present invention is that the press utilizes a single crankshaft to drive both the lower and upper slides as opposed to plurality of crankshafts. As a result of the single crankshaft, the press minimizes rotational inertia, which reduces detrimental effects on the clutch and brake and permits for an increase in production speeds. Additionally, such a construction minimizes the forces transmitted into the press foundation, frame, and associated factory floor or building.

Another advantage of the present invention is that of utilization of a drive mechanism that is below, i.e, an underdrive, both of the opposed reciprocating slides. The top slide is normally formed so that any leakage out of the lubrication system and top drives do not drip on the product itself, the workpieces, cans, or cups. The underdrive system simplifies press slide and crown design since there is no opportunity for oil leakage from the press drive on to the worked products.

A further advantage of the present invention is that the single crankshaft eliminates the potential timing problems found in multiple crankshaft presses. The single crankshaft also simplifies machining, assembly and service of the press.

Another advantage of the present invention is that the press structure disclosed is able to stop the reciprocating slides in no more than one crankshaft revolution. In case there is a direct press stop condition, an operator can halt the press without fracturing any associated tools or dies.

Yet another advantage of the present invention is that of a sealed machine having a sealed oil chamber including oil control. The press utilizes piston guides so that it is possible to control the oil in the hydrostatic and hydrodynamic bearings, with seals as well as controlling any leakage within a vacuum system. Vacuum equipped bearings are utilized on the piston guides attached to the slides. The piston guides permit the press to operate quickly without oil splashing out of the machine.

An additional advantage is that of a sealed oil chamber press versus an open chamber press. An open chamber press is where the oil from the lubrication system can splash out of the press or foreign matter from the environment can get into the circulating lubrication system. The present invention assists in prevention of such action.

Another advantage of the present invention is that of utilization of oil film bearings at all pivot points and positions, thus eliminating the problem of fretting. All loaded bearings utilize anti-friction bearings such that they are film monitored. On occasions when the bearing fails, an immediate change in bearing pressure occurs. This permits substantially instantaneous feedback on whether a bearing is operating correctly. Film monitored bearings, as opposed to temperature monitored bearings, permit the press to be shutdown prior to bearing damage by monitoring bearing pressure. The press obtains increased life expectancy since oil film bearings are disposed at all of the pivoting and moving joints, including upper and lower slide guiding, all of the pivot points, and the main crankshaft. With such improved oil film bearings press operation may stop and start in one crankshaft revolution.

Yet a further advantage of the present invention is reduction or elimination of the chemical solutions used during the redrawing or bodymaking process of beverage cans. The structure and drive mechanisms of the press do not overdraw the workpiece material. Such workpiece material is normally strip metal coated with a plastic coating. By the particular movement of the press, a reduction or elimination of solvents needed to keep most cup or container workpiece materials together is created as compared to prior double action presses.

Another advantage of the present invention is that the press mechanism has a marked reduction in the height by using a rocker arm assembly to drive the upper slide. By creating a height reduction of the entire press, costs associated with shipping are reduced since the press assembly may now be shipped by inter-modal carrier.

Another advantage of the present invention is that the press design could have benefits for drawing oil filters, drawing batteries, and other items sometimes accomplished in a container production, ultra clean atmosphere.

The invention, in one form thereof, includes a mechanical press having two slides disposed in opposed relationship to each other. A single crankshaft is connected to each slide whereby rotation of the crankshaft causes each slide to move toward and away from the other slide. A drive mechanism is used to rotate the crankshaft.

The invention, in another form thereof, includes a mechanical press having two slides disposed in opposed relationship to each other with a crankshaft connected to each slide whereby rotation of the crankshaft causes each slide to move toward and away from the other slide. A drive mechanism is used to rotate the crankshaft. A dynamic balancer is operably connected to one of said slides whereby press inertia is balanced to greater than 80 percent. In some embodiments, the dynamic balancer is connected directly to the slide.

The invention, in another form thereof, includes a mechanical press having two slides disposed in opposed relationship to each other with a crankshaft connected to each slide whereby rotation of the crankshaft causes each slide to move toward and away from the other slide. A drive mechanism is used to rotate the crankshaft to cause the slides to reciprocate at greater than 400 strokes per minute. A clutch/brake mechanism is connected to said drive mechanism to stop said press and dynamic balancer is operably connected to one of the slides to substantially balance press inertia, thereby permitting the brake mechanism to stop the press within one revolution of the crankshaft.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
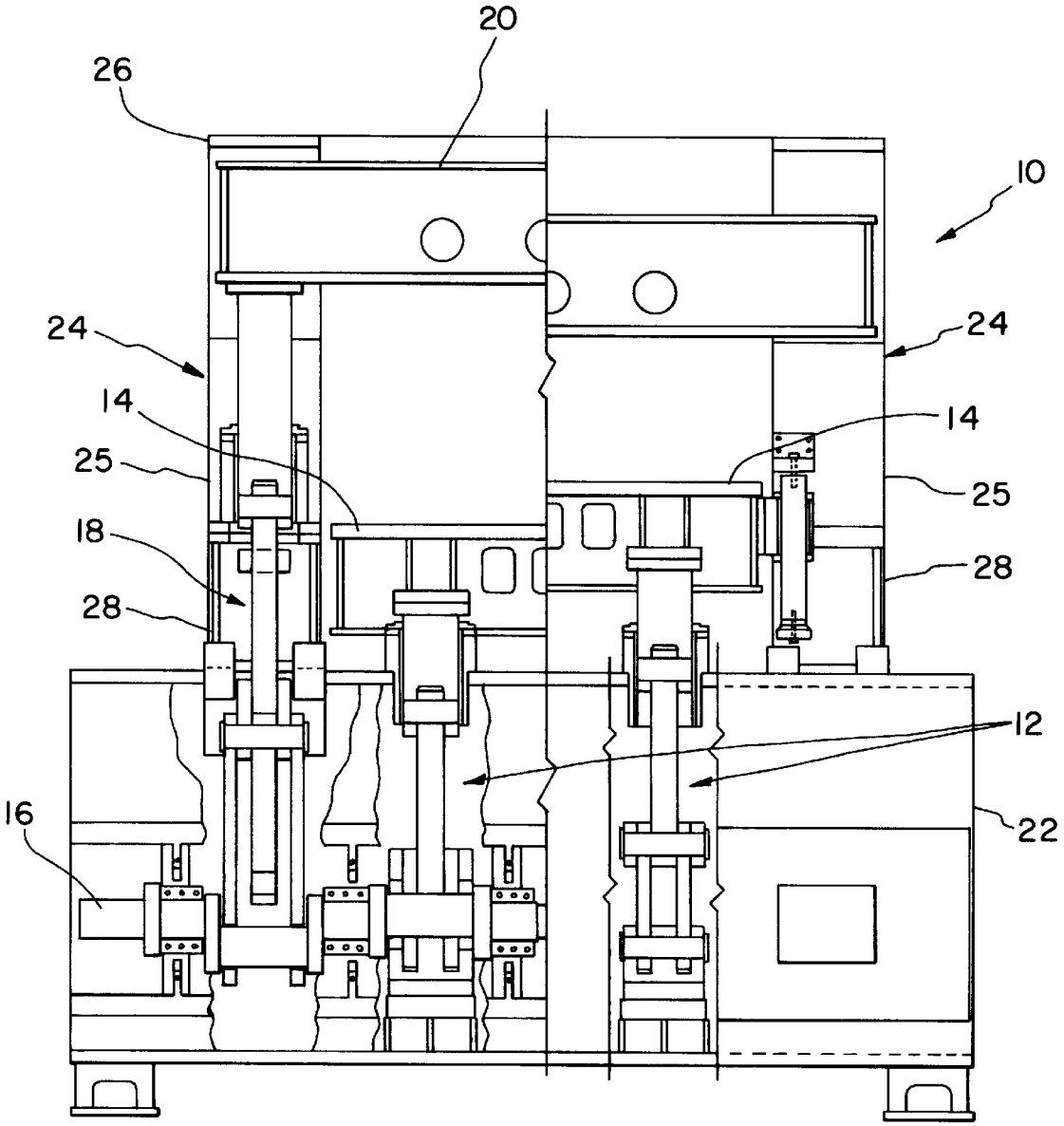
FIG. 1 is a front elevational view of an embodiment of the present invention.
Figure 2:
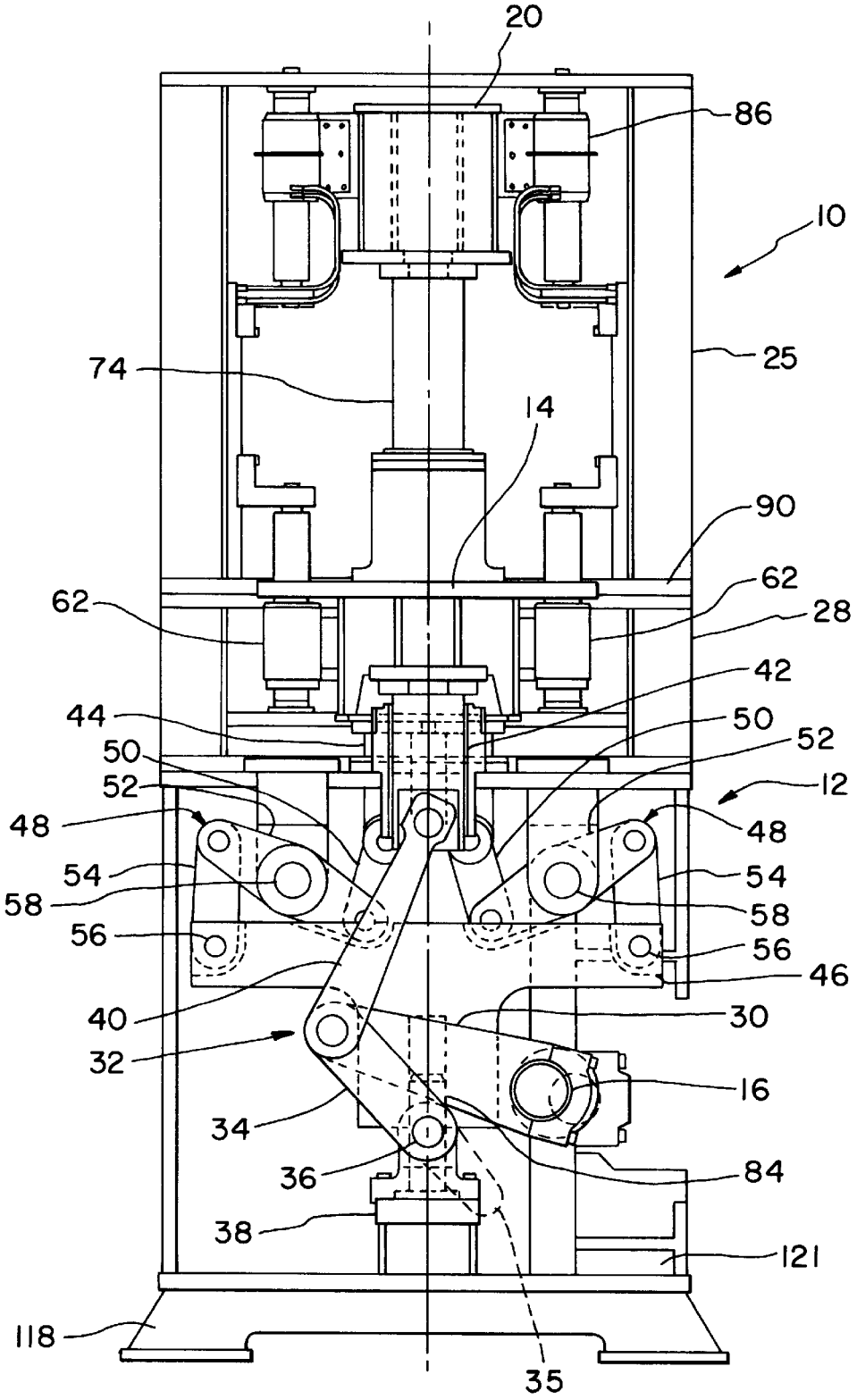
FIG. 2 is a side elevational view of an embodiment of the lower slide drive of the present invention.

Referring now to the drawings and particularly to FIGS. 1 and 2, an underdrive double slide press 10 of the present invention is shown. Press 10 includes a lower linkage mechanism 12 for reciprocating lower slide 14. Lower linkage mechanism 12 is driven by a crankshaft 16. An upper linkage mechanism 18 is also connected to crankshaft 16 to drive or reciprocate upper slide 20. Crankshaft 16 is located within a base 22 of press 10. Attached to base 22 are a pair of uprights 24. Uprights 24 are split into two sections, so there is an upper upright section 25 and a lower upright section 28. A press crown 26 is connected to upper uprights 25. Lower slide 14 and upper slide 20 are oriented opposite each other and during press operation move toward and away from each other.

FIG. 2 illustrates lower linkage mechanism 12 of lower slide 14. Crankshaft 16 is drivingly connected to a drive link connection 30. Drive link connection 30 is attached a knuckle joint mechanism 32. A lower link 34 of knuckle joint mechanism 32 is attached to a pivot point 36. Pivot point 36 is attached through a mounting 38 to the base 22 of press 10. Also attached to knuckle joint mechanism 32 is an upper link 40 disposed in an upward direction and attached to a drive piston 42. Drive piston 42 is attached to lower slide 14. Lower slide 14 is disposed between uprights 24 for reciprocation therebetween in an up and down direction relative to press base 22.

Also attached to lower slide 14 are two pistons 42 facing in a downward direction and connected to lower balancer (mass) 46 (FIG. 2). Lower balancer 46 is driven by two pairs of linkage assemblies 48. Linkage assemblies 48 each consist of an upper link 50 which is attached to piston 42. Upper link 50 connects to a rocker arm 52. At the opposite end of rocker arm 52 is a balancer link 54. Balancer link 54 is connected to lower balancer 46 by a pin joint 56. Rocker arm 52 pivots on pivot pin 58 and through this mechanism of piston 42 being driven by knuckle joint mechanism 32 via motion from crankshaft 16, two operations occur. The first is that piston 42 reciprocates upward and downward causing lower slide 14 to move up and down, and second that at the same time movement will be translated through linkage assemblies 48, that are in connection with lower balancer 46 to drive it in an opposing manner so as to counteract forces on slide 14 during operation. Such a dynamic balancer construction is preferred over a rotary balancers although a rotary balancer may be utilized.

Press 10 includes mirror assembly of linkage 48 toward the rear of press 10. With such a construction, counteraction of all the inertia forces applied to base 22 of the machine in the front and back direction are obtained. There are actually two drive link connectors 30 utilized to balance forces on crankshaft 16, oriented left and right relative to FIG. 1.

FIG. 2 illustrates both the front and the rear balancer linkage mechanisms in which the horizontal forces oppose each other so they balance themselves out, therefore there are no inertia forces being induced into press 10. Press 10 is balanced in that there are no side to side motions being induced by the balancer mechanism, i.e., lower balancer 46 and linkages 48.

FIG. 2 also illustrates lower slide guiding on the lower slide 14. On each corner of lower slide 14, is a guide housing 62, for a total of four guide housings 62. A slide piston 42 which provides guiding as the final drive train element. Slide piston 42 also has a guide housing 44 similar to that of guide housings 62. Guide housings 62 providing guiding to the slide. Guide housings 44, 62 are sealed, oil filled hydrodynamic piston bearings, utilizing oil from the press lubrication system (not shown).

Figure 12:
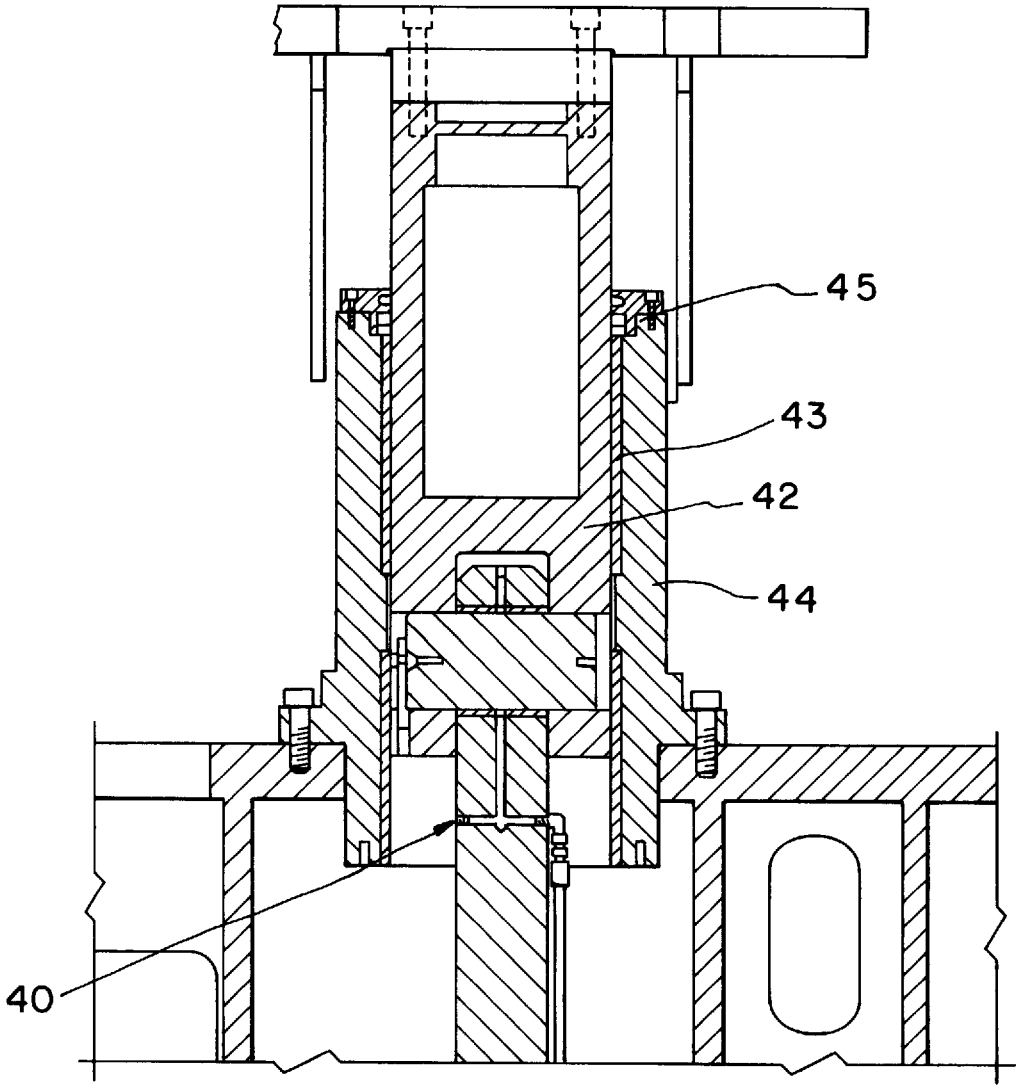
FIG. 12 is an enlarged sectional view of drive guide piston 44.

Guide housings 44, 62 include a fixed portion attached to the frame with an actual housing covering the fixed portion attached to the slide. A bushing (for example 43 as shown in FIG. 12 about slide piston 42) is disposed within the housing and pressurized oil is ported into the housing in contact with the bushing. Guiding is accomplished by an oil film created between moving metal portions within guide housings 44, 62. The oil film stiffens the interconnection and centers the housing about the fixed portion. Guide housings additionally include a vacuum housing (for example 45 as in FIG. 12) to prevent oil flow from escaping into contact with the press production area. Both hydrostatic and hydrodynamic oil pressure pads may be utilized within guide housings 44, 62. A squeeze film interface is generally developed at approximately 300 to 800 psi of the applied oil.

Figure 3:
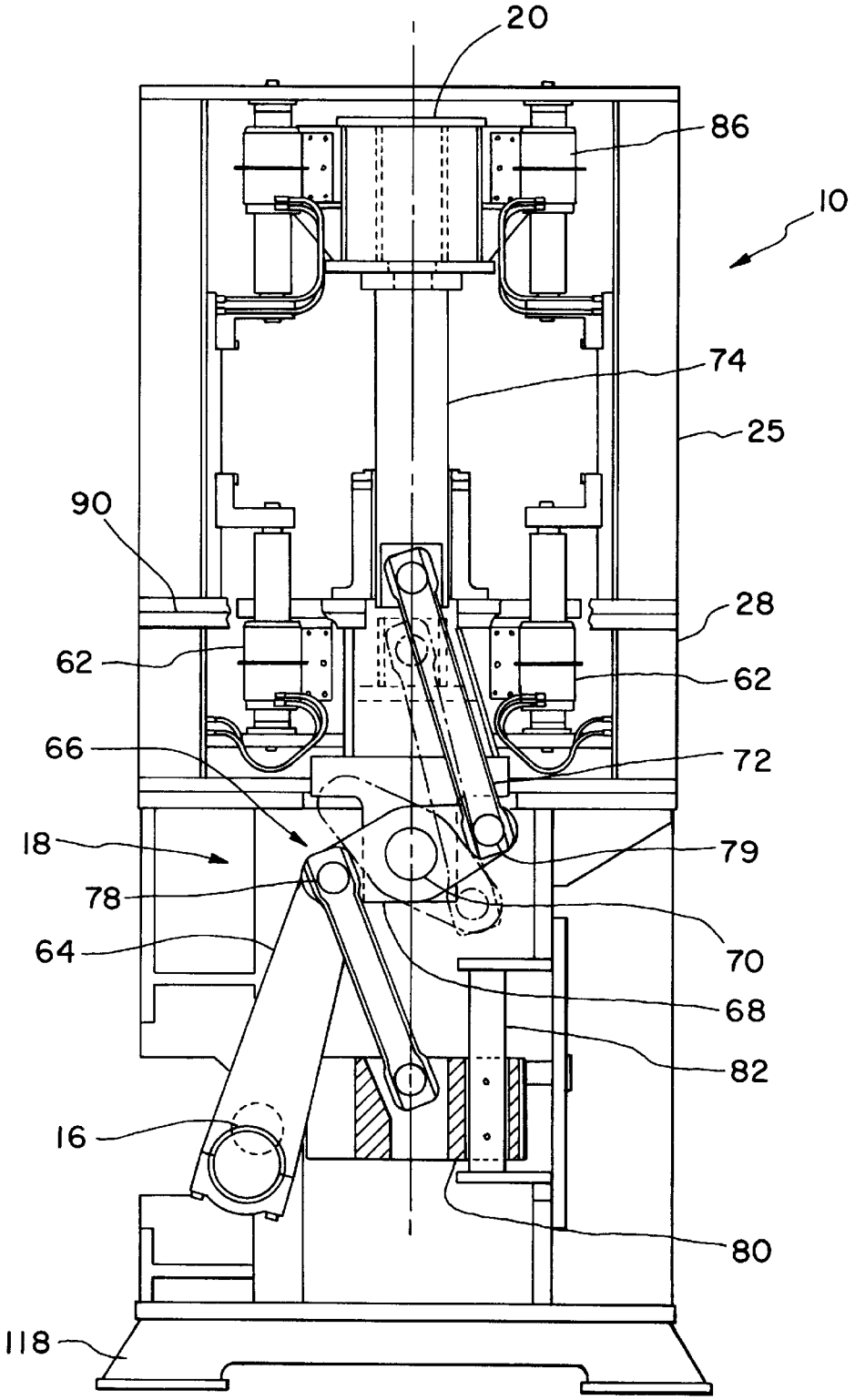
FIG. 3 is a side elevational view of an embodiment of the upper slide drive of the present invention.

FIG. 3 illustrates upper linkage mechanism 18 and upper balancer 80 for upper slide 20. The rotation of crankshaft 16 operates a connection arm 64 which is used to drive upper slide 20. A rocker arm assembly 66 connects to connection arm 64. Rocker arm assembly 66 includes a rocker arm 68 and a pin 70 attached to base 22. Connection arm 64 is connected to one side of rocker arm 68 by a pin 78. Rocker arm 68, on an opposite side from connection arm 64, is connected by a pivot pin 79 to a drive arm 72 which is connected to a drive piston 74. Drive piston 74 is pinned or attached to upper slide 20.

The upper balancer 80 which is driven off of rocker arm 68 has a drive arm 76 pointing generally downward and connected to the rocker arm assembly 68 at pin 78. One of the key points of this design is that balancing is achieved by connecting both the rocker arm 68 and drive arm 76 at the same pin 78, both connected to connection arm 64. At a bottom portion of drive arm 76 is attached an upper balancer (mass) 80 which is driven off of that rocker arm assembly 66. The motion of upper slide 20 and also of upper balancer 80 is nearly sinusoidal motion. By driving off opposite ends of rocker arm 68, press 10 obtains sinusoidal motion in upper slide 20 and an equivalent but opposite phase sinusoidal motion in upper balancer 80 and the strokes of those two mechanisms can be determined by the lengths of their driving arms 72, 76. The strokes of each driving arm 72, 76 can be proportioned as needed. By locating pivot pin 70 on rocker arm 68 one can achieve the same proportioning of the length of drive arms 72, 76.

Focusing again on the connection between crankshaft 16 and the connection arm 64 and drive link connection 30, the connection between arm 64 and connection 30 and crankshaft 16 is not concentric but actually operates with an eccentric portion on crankshaft 16 being connected through a bore in each connection arm 64 and drive link connection 30.

One of the features of upper balancer 80 is that it is guided by a single guide post 82. A unique aspect about single guide post 82 is that minimal thermal growth occurs thereby requiring no need for multiple guiding points. There is one guidepost for upper balancer 80 which offsets upper slide 20. The same one post design is also incorporated for a single balancer guide 84 for lower slide 14 shown in dotted lines on FIG. 2. There are minimal amounts of loads applied to guides 82 and 84 permitting single post use.

In comparison to attempting to balance press 10 with a single balancer having a single mass for a specific slide weight and speed, the present system is adjustable to balance the upper slide weight and lower slide weight separately. Once both slides 14 and 20 are substantially balanced, such press balance is achieved at any speed.

Upper slide 20 also includes four point guiding, utilizing four guide housings 86. As shown in FIG. 3, guide housings 86 are attached to upper slide 20 similar to the arrangement of guide housings 62 on lower slide 14. This provides guiding at the four extreme corners of upper slide 20 for better control of slide motion.

Referring again to FIG. 2, there is shown a lower upright structure, i.e., lower upright 28 and also upper upright 25. The reason upright 24 is split into two sections 25 and 28 is for shipping purposes. Such a design permits dismantling of press 10 and shipment on a truck or inter-modal carrier thereby not requiring any special permits. The design allows press 10 to be split in half without completely disassembling the entire machine. The entire drive assembly is shipped intact at split line 90. This is a difference and advantage over the prior art in which usually the drive system is disassembled for shipping. Another feature of the design is that upper upright section 25 along with guides 86 for upper slide 20 can be maintained as one unit so no reassembly of upper slide 20 and resetting of the guiding of press 10 is necessary. Press 10 is split along line 90 with lower uprights 28 connected to upper uprights 25 using fasteners, such as bolts or tie rods.

Figure 4:
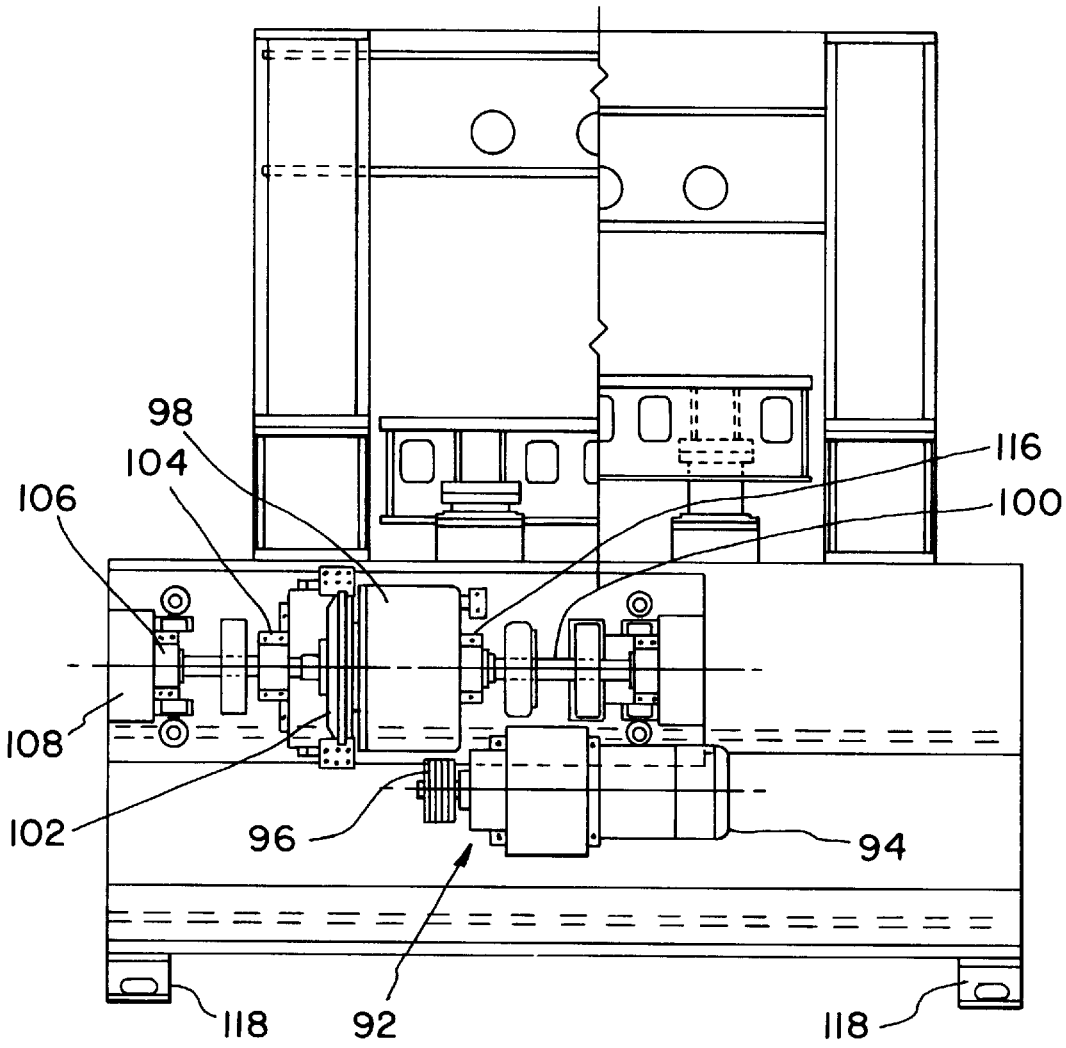
FIG. 4 is a front elevational view of an embodiment of the drive mechanism of the present invention.

FIG. 4 illustrates a front view of press 10 showing the driveshaft motor assembly 92, clutch assembly 102, motor drive 94 and how it is tied across the front of the press. As shown in FIG. 4, bolt-on feet 118 on base 22 of press 10. The reason bolt-on feet are utilized is to reduce shipping height thereby permitting shipment of the entire base drive assembly as a complete unit.

Figure 5:
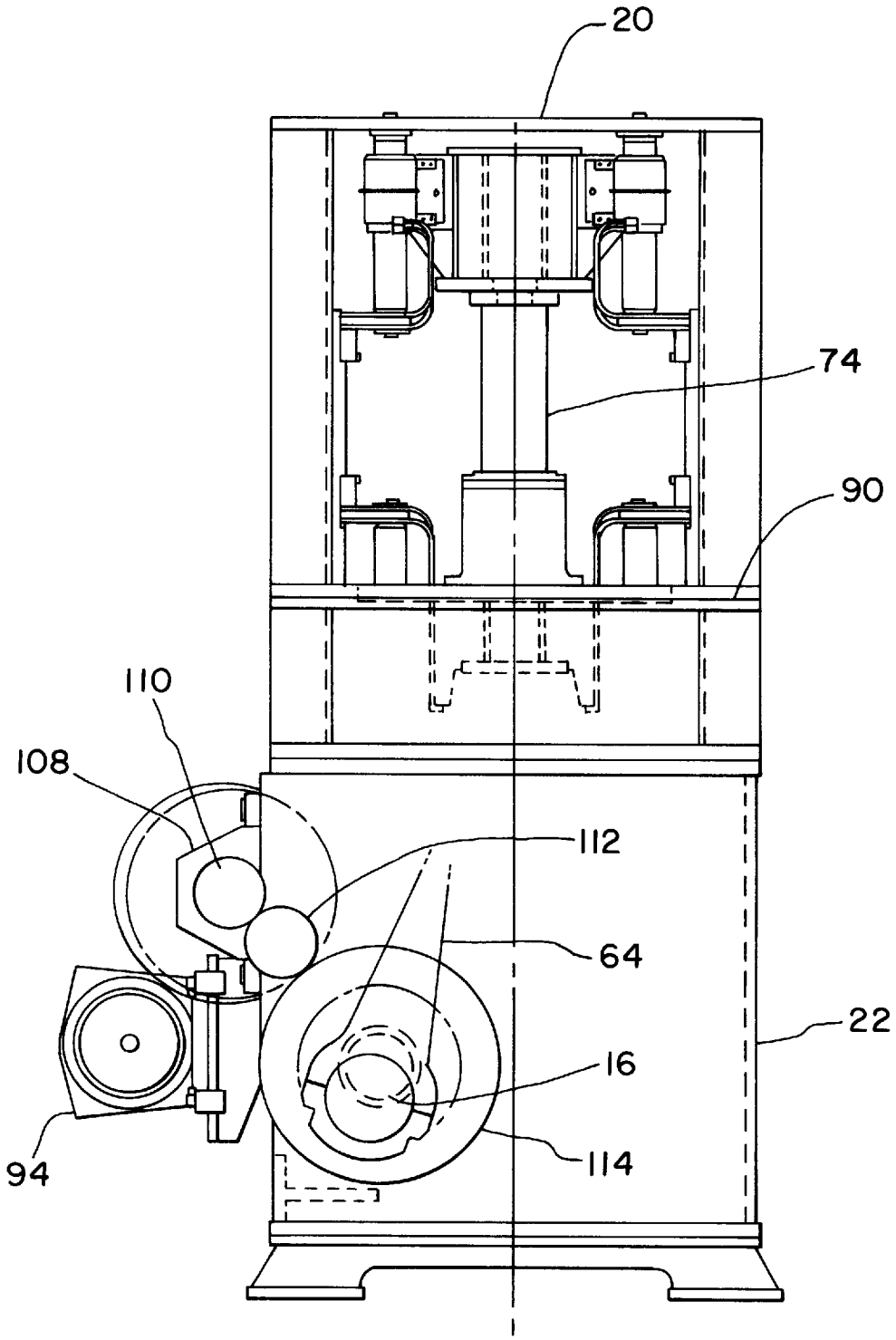
FIG. 5 is a side elevational view of an embodiment of the drive mechanism of the present invention.

FIG. 5 is a side elevational view showing the driveshaft motor assembly 92 and how it is tied and geared together with crankshaft 16. The driveshaft motor assembly 92 includes a motor 94 connected by V-belts 96 to a flywheel 98. The flywheel 98 is mounted on a driveshaft 100 and connected to a clutch/brake assembly 102. Clutch assembly 102, when engaged, drives the flywheel driveshaft assembly. Driveshaft 100 rotates down through a pillow block assembly 104 (mounted next to clutch assembly 102 but connected to driveshaft 100). A left hand pillow block assembly 106 is utilized for driveshaft 100 and a pinion cover 108. The pillow blocks 104 and 106, along with a right hand pillow block 116 located to the right of flywheel 98 are mounted to base 22 to support the entire driveshaft 100. Beneath pinion cover 108 is a pinion 110 that drives main gear 114 mounted on crankshaft 16. Referring to FIG. 5, pinion 110 is mounted on driveshaft 100 underneath pinion cover 108 to obtain the proper center distance between crankshaft 16 and driveshaft 100. An intermediate pinion gear 112 is mounted in the left hand end of base 22. From intermediate pinion gear 112 drive energy passes to main gear 114 mounted on the end of crankshaft 16.

An advantage of using intermediate pinion gear 112 is that it allows use of a smaller drive main gear 114 which further minimizes the amount of inertia in press 10.

Figure 6:
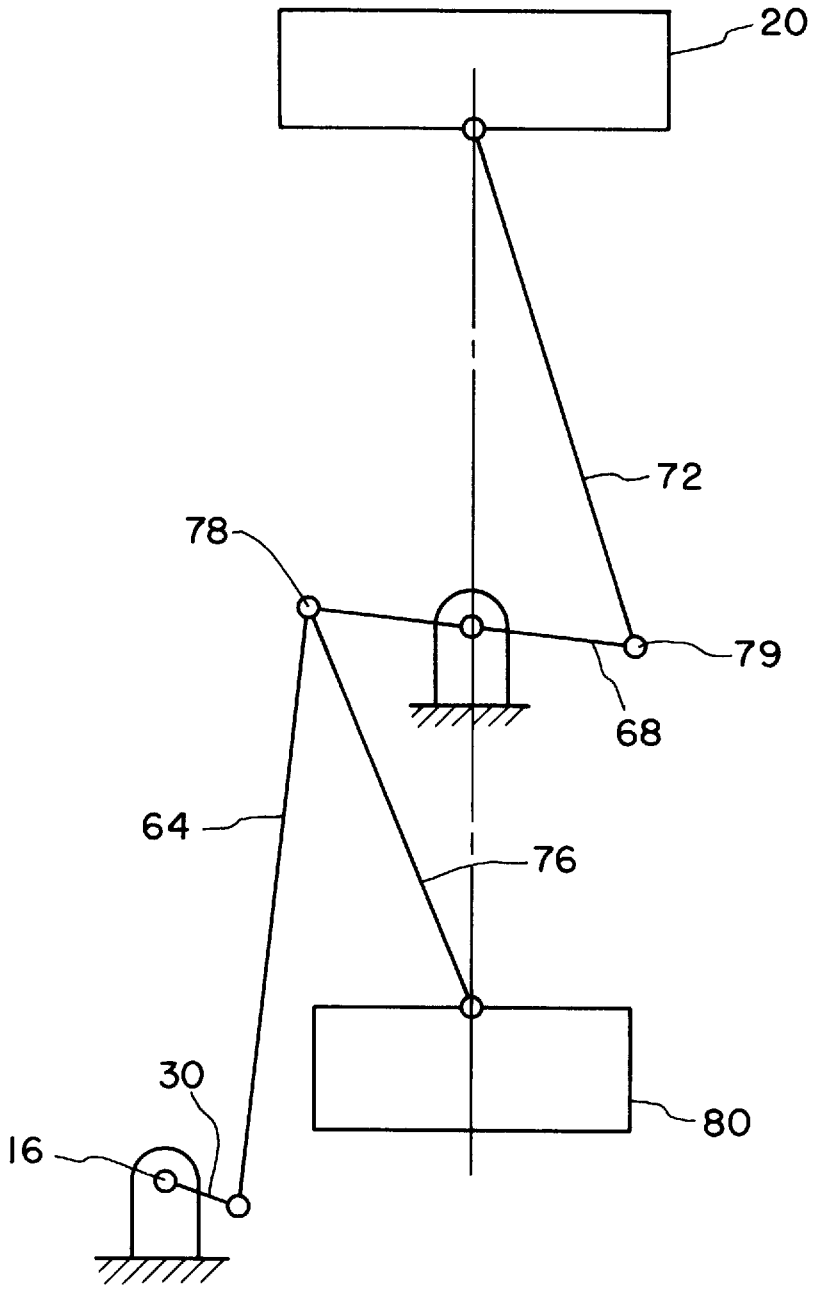
FIG. 6 is a dimensional drawing of the upper slide and balancer shown in FIG. 3.

FIG. 6 shows a schematic for the mechanism which drives upper slide 20 and upper balancer 80. FIG. 6 includes dimensions of rocker arm assembly 66 and also shows the approximate weights of those indicated items.

Figure 7:
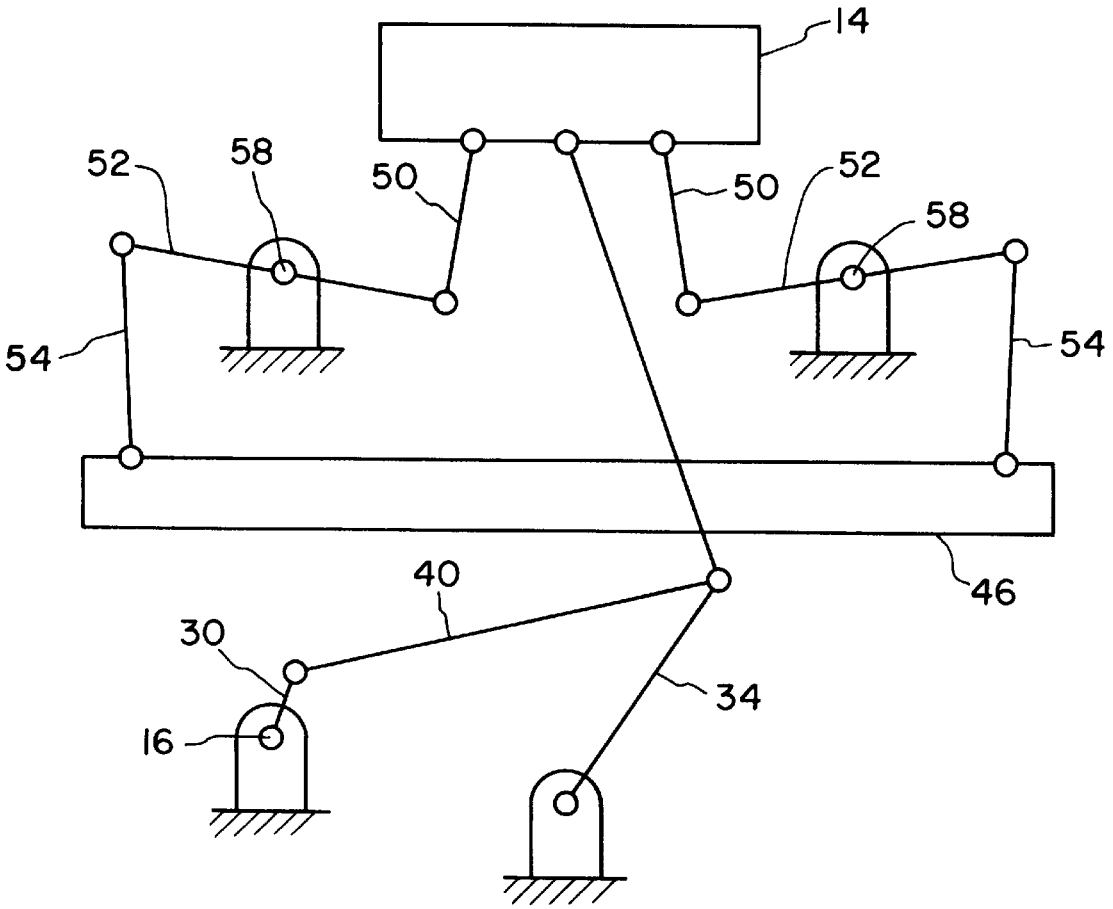
FIG. 7 is a dimensional drawing of the lower slide and balancer shown in FIG. 3.

FIG. 7 shows a schematic for lower slide 14 and lower balancer 46. FIG. 7 includes a depiction of possible weights for lower slide 14, the weight for lower balancer 46, and also the dimensions for knuckle joint mechanism 32.

Figure 8:
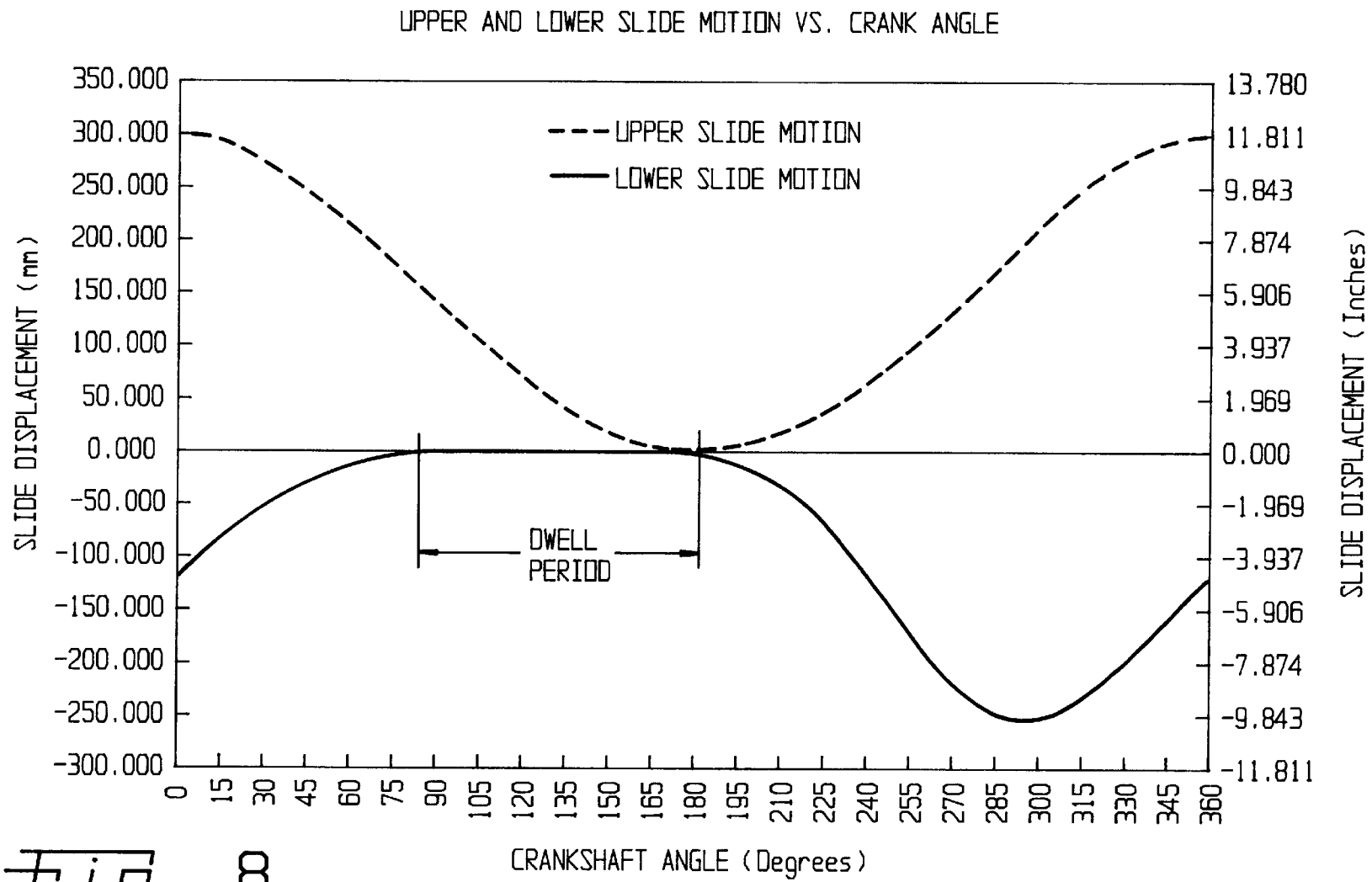
FIG. 8 is a graph comparing press slide displacement to the crankshaft angle.

FIG. 8 shows the resulting motion which is obtained from the linkages which drive upper and lower slides 20, 14. In this graph the solid line is the motion for lower slide 14, and the dashed line is the motion for upper slide 20. The X-axis illustrates a crankshaft angle from 0° to 360°, i.e., a complete revolution of crankshaft 16 and the Y-axis shows the displacement: of slides 14 and 20 showing the respective positions, upper slide 20 being the positive position coming down to zero and lower slide 14 being in the negative position coming up to the zero position. The motion of lower slide 14 shows a prolonged dwell period providing press 10 with the ability to draw the cup or workpiece out with upper slide 20 during that dwell period. At the end of the dwell, upper slide 20 retracts back up and lower slide 14 retracts back down. The dwell period averaging between crank angle 90° and 180° is labeled as "dwell period".

The dwell period provides zero or relatively no motion on lower slide 14 allowing a lower die (not shown) to remain in a fixed position while upper slide 20 is drawing the workpiece or cup out. At the end of the dwell period, then the lower die can retract back out to allow for transfer of the completed workpiece out of press 10. The relative position between the two slides 14 and 20 is changed more slowly than conventional presses, so the dwell period gives advantages of controlling the draw up and down on the piece at the same time, i.e., it reduces drawing. The controlled motion of lower slide 14 reduces the drawing speed on the workpiece or cup because lower slide 14 is essentially in a dwell period, i.e., it is in a fixed position. Upper slide 20 is the only slide that is in motion at that point. The advantage is that laminated material utilized in cup form can be drawn into a can form while no additional steps of coating the inside of the can are needed. If drawing speeds of lower slide 14 and upper slide 20 are so controlled, operation of press 10 creates a better part by maintaining a uniform coating on the inside of that workpiece when drawing is complete.

Figure 9:
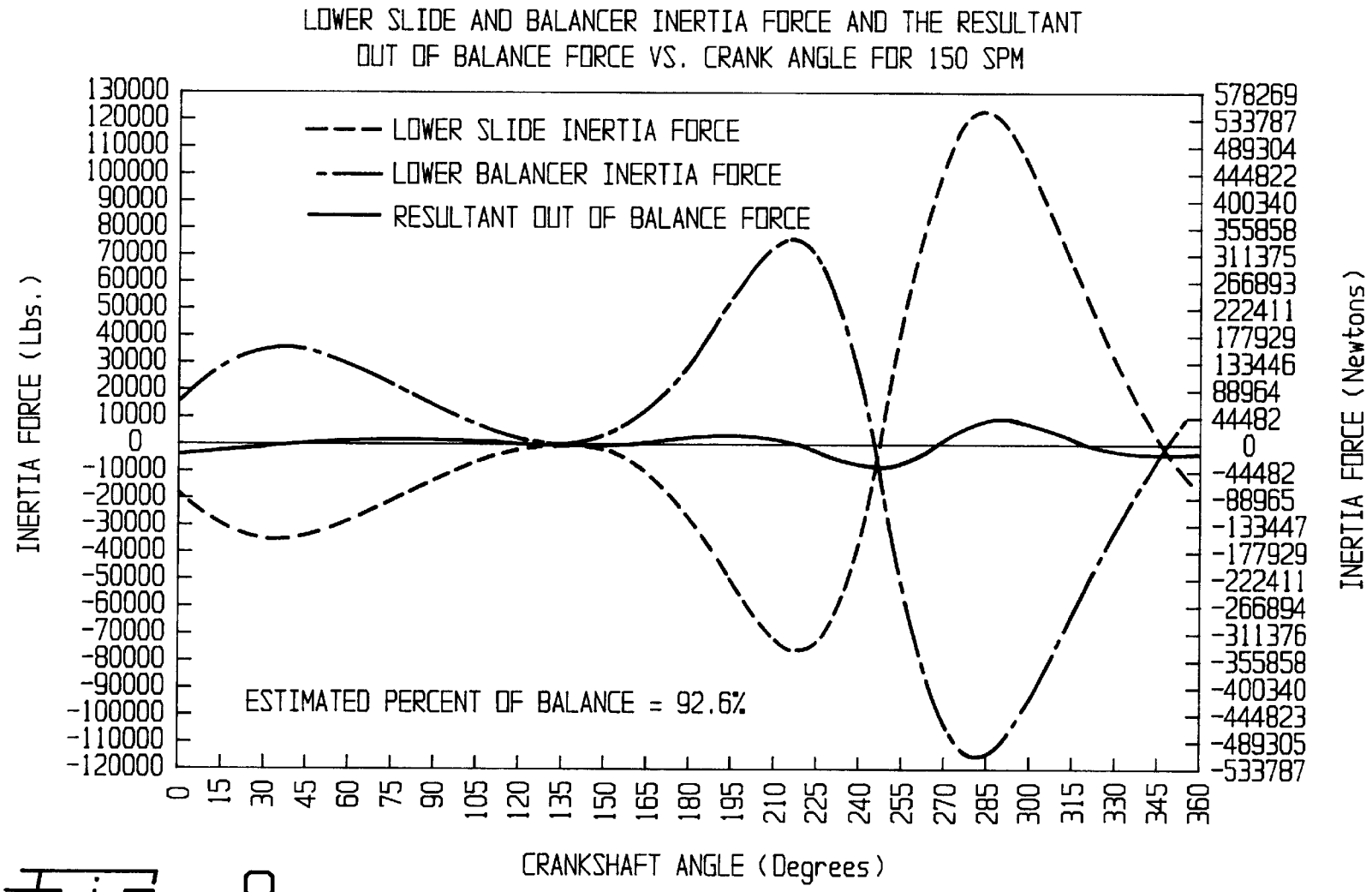
FIG. 9 is a graph comparing lower slide and lower balancer forces to the crankshaft angle.

FIG. 9 shows lower slide 14 and balancer inertia forces and the resultant out of balance forces created at 150 strokes per minute. The X-axis is again the crankshaft angle being shown from 0° to 360° and the Y-axis are the inertial forces being induced into the machine. The dashed line is the lower slide inertial force curve and the dashed-solid line is the lower balancer inertia force, while the solid line is the resultant out of balance force curve. The percent of balance on the lower slide, the resultant, is 92.6 percent balanced. That is achieved by the particular structure of the counter balance weights attached to either rocker arm 52 or 68 for either the upper or lower slide 20,14.

Figure 10:
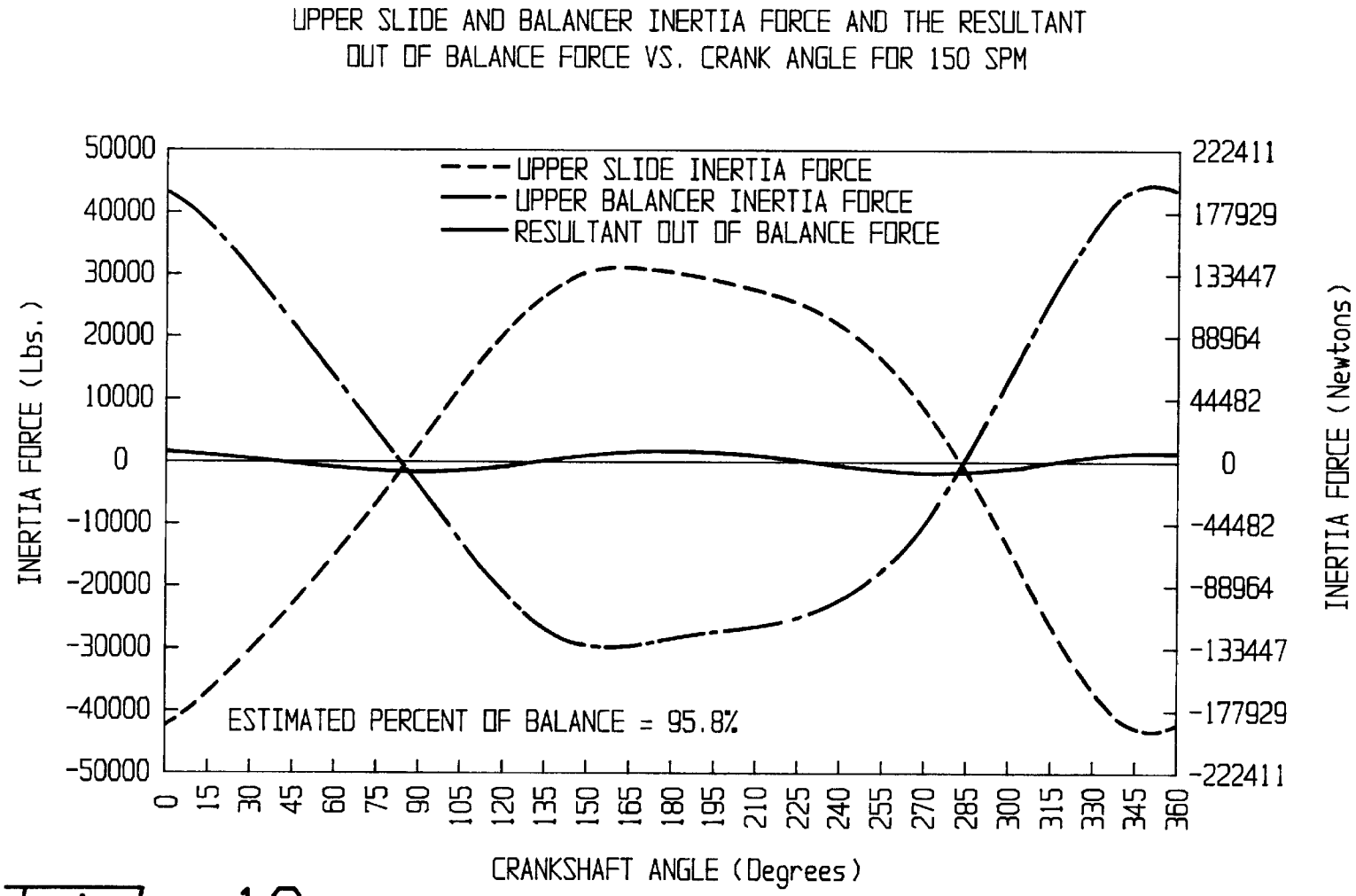
FIG. 10 is a graph comparing upper slide and upper balancer forces to the crankshaft angle.

FIG. 10 shows upper slide 20 and balancer inertia forces and the resultant out of balance force curve at 150 strokes per minute. The X-axis again is the crankshaft angle from 0° to 360° and the Y-axis is the inertial force in pounds and in Newtons. The dashed line is the upper slide inertial force, the dashed-solid line is the upper balancer inertial force and the solid line is the resultant, out of balance force. The percent of balance for the upper slide is 95.8 percent.

Figure 11:
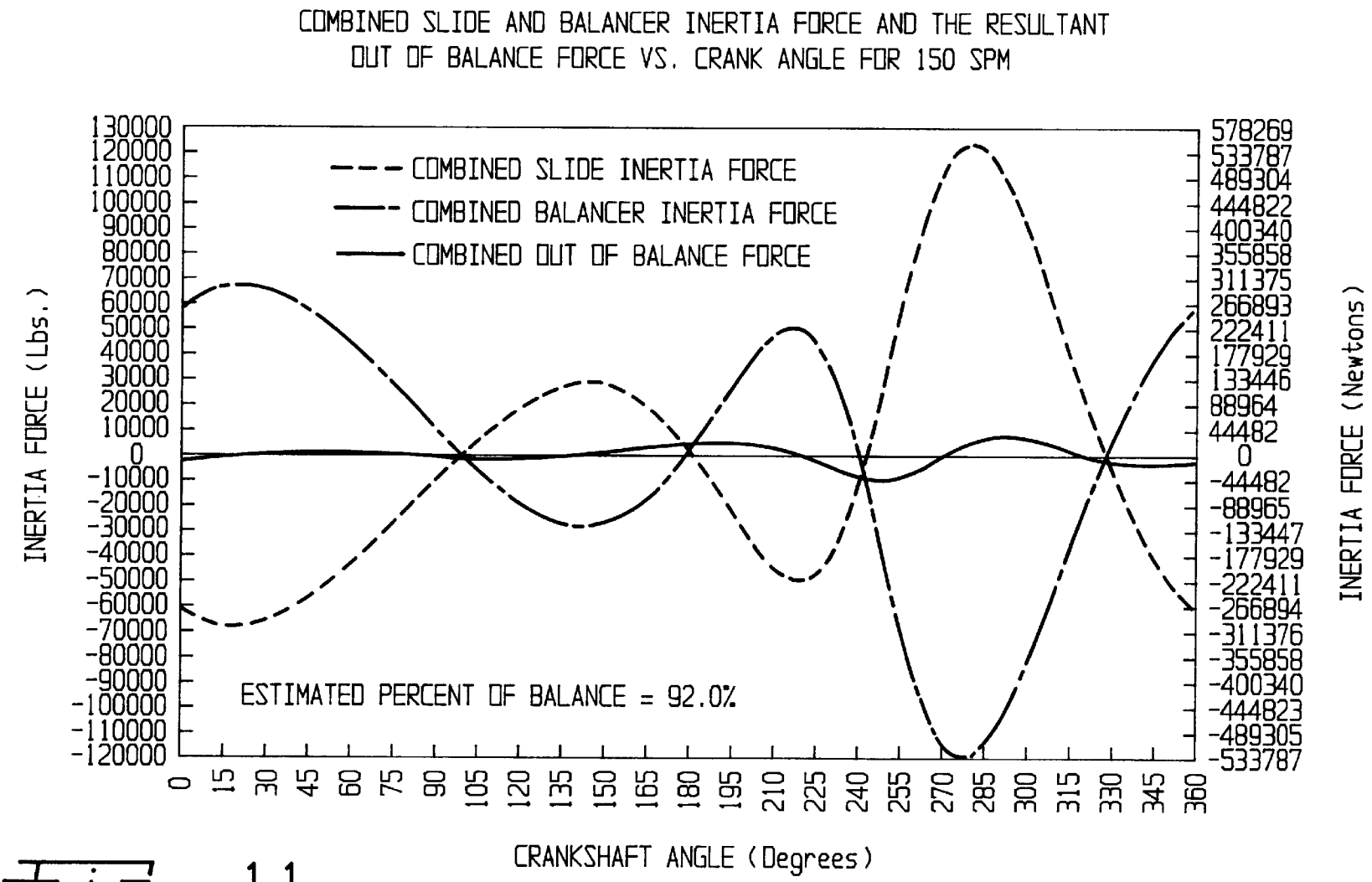
FIG. 11 is a graph comparing combined forces on the upper and lower slides and upper and lower balancer to the crankshaft angle.

FIG. 11 illustrates the combined slide and balancer inertia force. The dashed line is the combined slide inertia force curve, the dashed solid line is the combined balancer inertia force curve and the solid line being combined out of balance force for the entire machine. The X-axis shows the crankshaft angle in degrees and the Y-axis is the inertia forces in the vertical direction. This curve is a summation of the forces plotted in FIGS. 9 and 10. The combined out of balance force that illustrates a balance of 92 percent of the total inertia forces is a result of the individual balancers that are being used to balance upper and lower slides 20 and 14. Various amounts of balance may be obtained by adjusting the mass of balancers 46 and 80. It has been found that with balance of above 80 percent of press inertia forces press stop and start operations may take place in one revolution or less of crankshaft 16.

To more clearly define what is meant by an out of balance percentage for this application, an out of balance percentage is calculated by taking the maximum out of balance force through the entire stroke of crankshaft 16 and dividing that value by the maximum inertia force of either the particular slide that is in question or the combined inertia force of both slides. Then multiplying that result by 100 percent to get a percentage. The total amount of out of balance that occurs through the entire stroke, a peak value is the calculated value. The above description concerns only inertial force in a vertical plane.

The geometry of the slide linkages are such that by placing masses, slide links 34 and 40 are arranged in such a way that horizontal inertia forces created by their own motion are balanced. Balance against vertical linear motion of the slides by may be created by placing weights in appropriate places, i.e., in positions that have contrary motion to the center of mass of the links or drive arms. FIG. 3, for example, shows motion of drive arm 72 which is connected to upper slide 20 and drive arm 76 which is connected to upper balancer 80. The drive arms themselves are moving in opposite directions to one another in the vertical direction and therefore in essence act as balancers to one another. Also they are arranged in such a way that pins 78, 79 where each is connected to rocker arm 68 will move in opposite directions as well. These pins 68 and 69 have motion opposite to one another.

Referring again to FIG. 2, lower link 34 which drives lower slide 14 includes some horizontal forces that are not balanced. One possible way to balance that force would be to extend lower link 34 down beyond pivot point 36. By extending that lower link 34 down further and adding a mass to the end such as shown by dashed line 35, the structure will offset the horizontal forces being induced by link 34 to help balance the horizontal forces.

An oil chamber 121 is located below lower slide 14. Oil within oil chamber 121 is used for all the hydro-dynamic bearings. All of those bearings with the exception of the slide bearings would be below the die set, so that any oil leakage that may occur would be below the product or workpiece and therefore not contaminate the product. The slide guides 60 on slides 14 and 20 are above the product, but are on the extreme edges of the product in the production area; therefore, if there is any leakage it will not fall onto the product.

All of the bearing surfaces of the linkages, connection arms, and pivot pins utilize oil film bearings for increased press life and pressure sensors to determine bearing malfunction.

The motion on upper slide 20 alternatively may be duplicated through a slider crank mechanism. Then it may be necessary to provide a balancer for such a slider crank mechanism that would not add height to the machine.

Alternatively, a press could use a single balancer driven by a linkage. The single balancer would balance the combination of the motions of the upper and lower slides. Because the resultant force as seen by the press would not be sinusoidal, a linkage to simulate that motion would be needed. The single balancer would be driven off of the single crankshaft. Such a linkage would connect to either the upper or lower slide with the linkage being used to balance both slides.

In operation, press 10 operates by motor 94 applying rotational energy to flywheel 98 via V-belts 96. When clutch/brake assembly 102 is engaged, rotational energy passes from flywheel 98 to crankshaft 16 via driveshaft 100 and pinion gears 110, 112 and main gear 114. Rotation of crankshaft 16 causes eccentrically attached drive linkage connections 30 and connection arms 64 and the previously discussed linkages to respectively actuate their connected slides 14 and 20 in rectilinear motion. Normal press speeds may be varied between 150 and 600 revolutions per minute of crankshaft 16 with the above disclosed press without press movement or excess vibration.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A mechanical press comprising:

two slides disposed in opposed relationship to each other, said two slides comprising an upper slide and a lower slide;

a single crankshaft to which is connected each said slide, whereby rotation of said single crankshaft causes each said slide to move toward and away from the other slide;

a drive mechanism to rotate said single crankshaft; and a dynamic balancer connected to said upper slide to balance said press.

2. A mechanical press comprising:

two slides disposed in opposed relationship to each other;

a crankshaft connected to each said slide whereby rotation of said crankshaft causes each said slide to move toward and away from the other said slide;

a drive mechanism to rotate said crankshaft; and a dynamic balancer operably connected to one of said slides whereby press inertia is balanced to greater than 80 percent and vibration severity is less than 0.52 inches per second squared.

3. The press of claim 2 in which said dynamic balancer balances said press inertia to greater than 90 percent.

4. The press of claim 2 in which said press further includes a slide piston attached between one of said slides and said crankshaft to guide said one of said slides in rectilinear motion.

5. The press of claim 2 in which said crankshaft is located below both said slides.

6. A mechanical press comprising:

two slides disposed in opposed relationship to each other;

a crankshaft connected to each said slide whereby rotation of said crankshaft causes each said slide to move toward and away from the other said slide;

a drive mechanism to rotate said crankshaft to cause said slides to reciprocate greater than 400 strokes per minute;

a clutch/brake mechanism connected to said drive mechanism to stop said press; and a dynamic balancer operably connected to one of said slides to substantially balance press inertia, thereby permitting said brake mechanism to stop said press within one revolution of said crankshaft.

7. The press of claim 6 in which one of said slides has a dwell time during operation, said dynamic balancer balancing the inertia of said one of said slides having a dwell time during operation during said dwell time.

8. The press of claim 6 in which said press further includes a slide piston attached between one of said slides and said crankshaft to guide said one of said slides in rectilinear motion.

9. The press of claim 6 in which said crankshaft is located below both said slides.

10. A mechanical press comprising:

two slides disposed in opposed relationship to each other;

a rocker arm attached to one of said slides;

a single crankshaft to which is connected each said slide, whereby rotation of said single crankshaft causes each said slide to move toward and away from the other said slide;

a dynamic balancer connected to said rocker arm whereby said dynamic balancer is driven from said one of said slides rather than said crankshaft; and a drive mechanism to rotate said single crankshaft.

11. A mechanical press comprising:

two slides disposed in opposed relationship to each other;

said two slides comprising an upper slide and a lower slide;

a dynamic balancer connected to said lower slide to balance said press;

a single crankshaft to which is connected each said slide, whereby rotation of said single crankshaft causes each said slide to move toward and away from the other said slide; and a drive mechanism to rotate said single crankshaft.

12. A mechanical press comprising:

two slides disposed in opposed relationship to each other;

said two slides comprise an upper slide and a lower slide;

a dynamic balancer connected to said upper slide and a second dynamic balancer connected to said lower slide to balance said press, said first and second dynamic balancers are driven by movement of their respective slides;

a single crankshaft to which is connected each slide, whereby rotation of said single crankshaft causes each said slide to move toward and away from the other said slide; and a drive mechanism to rotate said single crankshaft.

13. A mechanical press comprising:

two slides disposed in opposed relationship to each other;

a single crankshaft to which is connected each said slide, whereby rotation of said single crankshaft causes each said slide to move toward and away from the other said slide;

a drive mechanism to rotate said single crankshaft; and a slide piston attached between one of said slides and said crankshaft to guide said one of said slides in rectilinear motion.

* * * * *